US011718492B2

(12) United States Patent
Eguchi

(10) Patent No.: US 11,718,492 B2
(45) Date of Patent: Aug. 8, 2023

(54) IMAGE PROCESSING APPARATUS

(71) Applicant: TOSHIBA TEC KABUSHIKI KAISHA, Tokyo (JP)

(72) Inventor: Atsuhiko Eguchi, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/468,887

(22) Filed: Sep. 8, 2021

(65) Prior Publication Data

US 2023/0070418 A1 Mar. 9, 2023

(51) Int. Cl.

*B65H 7/12* (2006.01)
*B65H 5/06* (2006.01)
*B65H 5/24* (2006.01)

(52) U.S. Cl.

CPC ..... *B65H 7/125* (2013.01); *B65H 5/062* (2013.01); *B65H 5/24* (2013.01); *B65H 2511/524* (2013.01); *B65H 2553/30* (2013.01)

(58) Field of Classification Search

CPC ..... B65H 7/125; B65H 5/062; B65H 5/24; B65H 2511/524; B65H 2553/30

See application file for complete search history.

(56) References Cited

U.S. PATENT DOCUMENTS 7,445,209 B2 * 11/2008 Sano ..... B65H 7/125 271/145
2008/0088084 A1 * 4/2008 Shimazaki ..... B65H 7/12 271/262
2015/0048566 A1 * 2/2015 Utagawa ..... B65H 3/5261 271/10.02
2017/0057768 A1 3/2017 Arima et al.

* cited by examiner

*Primary Examiner* — Thomas A Morrison
(74) *Attorney, Agent, or Firm* — Amin, Turocy & Watson, LLP

(57) ABSTRACT

An image processing apparatus includes a transmitter, a receiver, a comparison circuit, and a control unit. The transmitter transmits an ultrasonic wave to a conveyance path through which a sheet is conveyed. The receiver faces the transmitter with the conveyance path in between, and receives the ultrasonic wave transmitted by the transmitter. The comparison circuit compares a level signal indicating a reception level of the ultrasonic wave received by the receiver with a threshold signal for determining whether or not the sheet is double-fed in the conveyance path, and outputs a comparison result signal according to the comparison result. The control unit determines whether or not there is a possibility of a defect in the double feed detection function of detecting double feed based on the comparison result signal and the level signal.

12 Claims, 9 Drawing Sheets

IMAGE PROCESSING APPARATUS

FIELD

Embodiments described herein relate generally to an image processing apparatus, methods of monitoring double feeding, and double feed monitoring systems.

BACKGROUND

In the related art, in an image processing apparatus such as a scanner or a printer that conveys sheets, double feeding may occur in which the sheets are conveyed while being overlapped. There is a double feed detection sensor for detecting double feeding. The double feed detection sensor includes, for example, a transmitter and a receiver. The transmitter transmits an ultrasonic wave to a conveyance path through which a sheet is conveyed. The receiver is provided so as to face the transmitter with the conveyance path in between, and receives the ultrasonic wave transmitted by the transmitter.

If one sheet is conveyed between the receiver and the transmitter, the ultrasonic wave output from the transmitter is attenuated, and the attenuated ultrasonic wave is received by the receiver. It is known that in the case of double feeding, a slight air layer between the sheets attenuates the ultrasonic wave more than in the case of one sheet.

However, even if the attenuated ultrasonic wave is received, some defect may occur in the double feed detection sensor or the like. Therefore, it is difficult to determine whether the detected double feed is due to a true double feed or a defect.

DETAILED DESCRIPTION

In general, according to one embodiment, an image processing apparatus includes a transmitter, a receiver, a comparison circuit, and a control unit. The transmitter transmits an ultrasonic wave to a conveyance path through which a sheet is conveyed. The receiver is provided so as to face the transmitter with the conveyance path in between, and receives the ultrasonic wave transmitted by the transmitter. The comparison circuit compares a level signal indicating a reception level of the ultrasonic wave received by the receiver with a threshold signal for determining whether or not the sheet is double-fed in the conveyance path, and outputs a comparison result signal according to the comparison result. Based on the comparison result signal and the level signal, the control unit determines whether or not there is a possibility of a defect in a double feed detection function for detecting double feed. According to another embodiment, a method of monitoring double feeding of sheets involves transmitting an ultrasonic wave to a conveyance path through which a sheet is conveyed; receiving the ultrasonic wave transmitted through the conveyance path by the transmitter; comparing a level signal indicating a reception level of the ultrasonic wave received with a threshold signal for determining whether or not sheets are double-fed in the conveyance path, and outputting a comparison result signal according to a comparison result; and determining whether or not there is a possibility of a defect in a double feed detection function of detecting double feed based on the comparison result signal and the level signal.

Hereinafter, an image processing apparatus of an embodiment will be described with reference to drawings.

Figure 1:
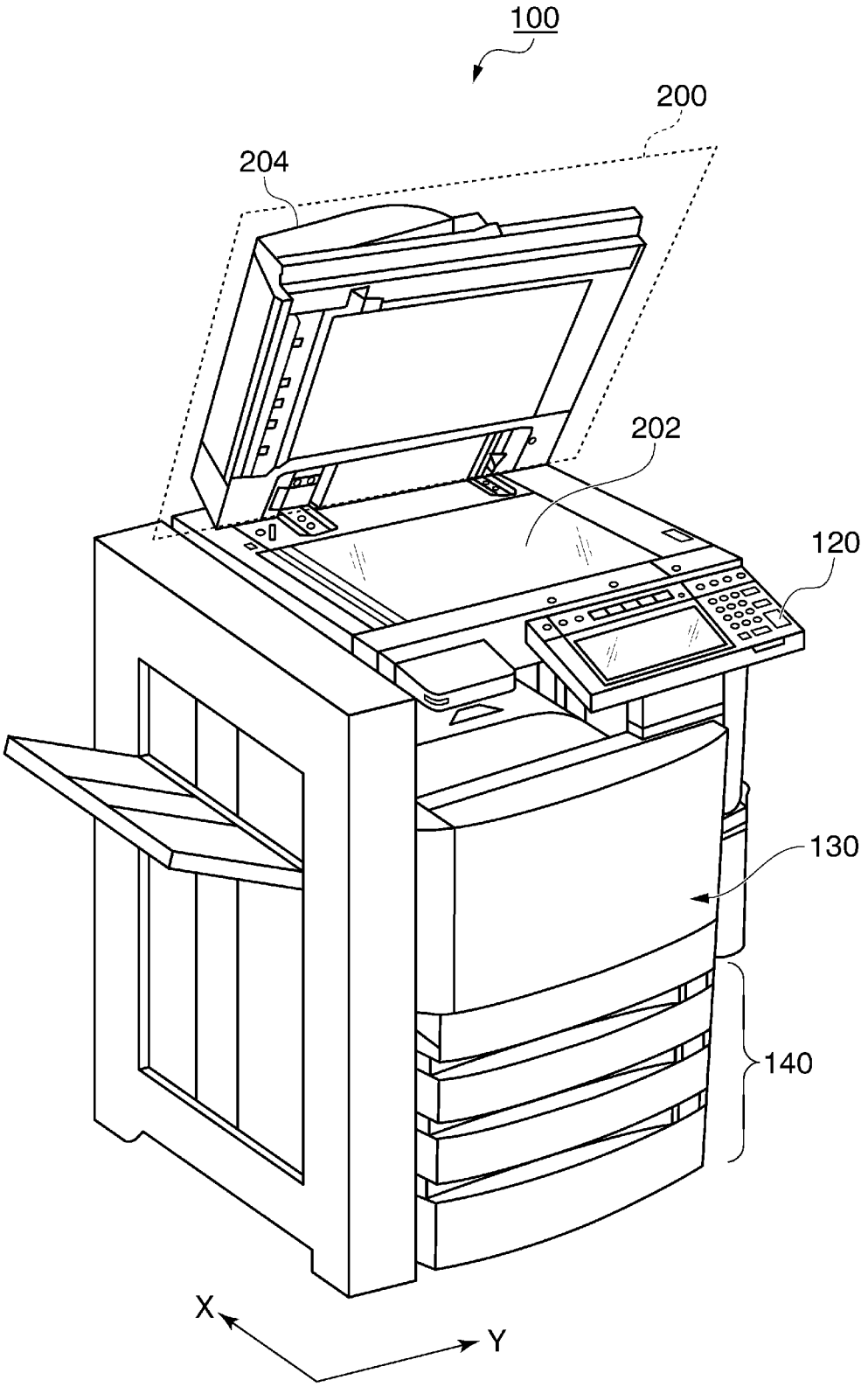
FIG. 1 is an external view of an image processing apparatus 100 of an embodiment.

FIG. 1 is an external view of an image processing apparatus 100 of the embodiment. The image processing apparatus 100 is, for example, a multi-function peripheral. The image processing apparatus 100 includes a control panel 120, a printer unit 130, a sheet accommodating unit 140, and an auto document feeder (ADF) 200. The ADF 200 is an example of an automatic document feeder that automatically conveys sheets.

The image processing apparatus 100 forms an image on a sheet by using a developer such as toner. The sheet is, for example, paper or label paper. The sheet may be of any type as long as the image processing apparatus 100 can form an image on the surface thereof.

The control panel 120 has a plurality of buttons. The control panel 120 receives a user's operation. The control panel 120 outputs a signal corresponding to the operation performed by the user to the control unit of the image processing apparatus 100. The control panel 120 includes a display such as a liquid crystal display and an organic electro luminescence (EL) display. The display displays various information on the image processing apparatus 100.

The printer unit 130 forms an image on a sheet based on the image information obtained by reading by the ADF 200 or the image information received via the communication path. The printer unit 130 forms an image by the following processing, for example. An image forming unit of the printer unit 130 forms an electrostatic latent image on a photosensitive drum based on the image information. The image forming unit of the printer unit 130 forms a visible image by attaching the developer to the electrostatic latent image.

A specific example of the developer is toner. A transfer unit of the printer unit 130 transfers the visible image to the sheet. A fixing unit of the printer unit 130 fixes the visible image on the sheet by heating and pressurizing the sheet. The sheet on which an image is to be formed may be a sheet accommodated in the sheet accommodating unit 140 or may be a sheet set by hand.

The sheet accommodating unit 140 accommodates a sheet used for image formation in the printer unit 130.

The ADF 200 is attached to the upper surface of the image processing apparatus 100 so as to be opened and closed, and also serves as a platen cover. An ADF cover 204 is a cover that opens and closes if double feed is detected or if a paper jam occurs. By opening the ADF cover 204, the user can remove the double-fed sheet and the sheet that caused the paper jam.

The X and Y directions used in FIGS. 2 and 3, which will be described later, will be described. As illustrated in FIG. 1, the X direction is the depth direction of the image processing apparatus 100, and the Y direction is the direction from left to right when the image processing apparatus 100 is viewed from the front.

Figure 2:
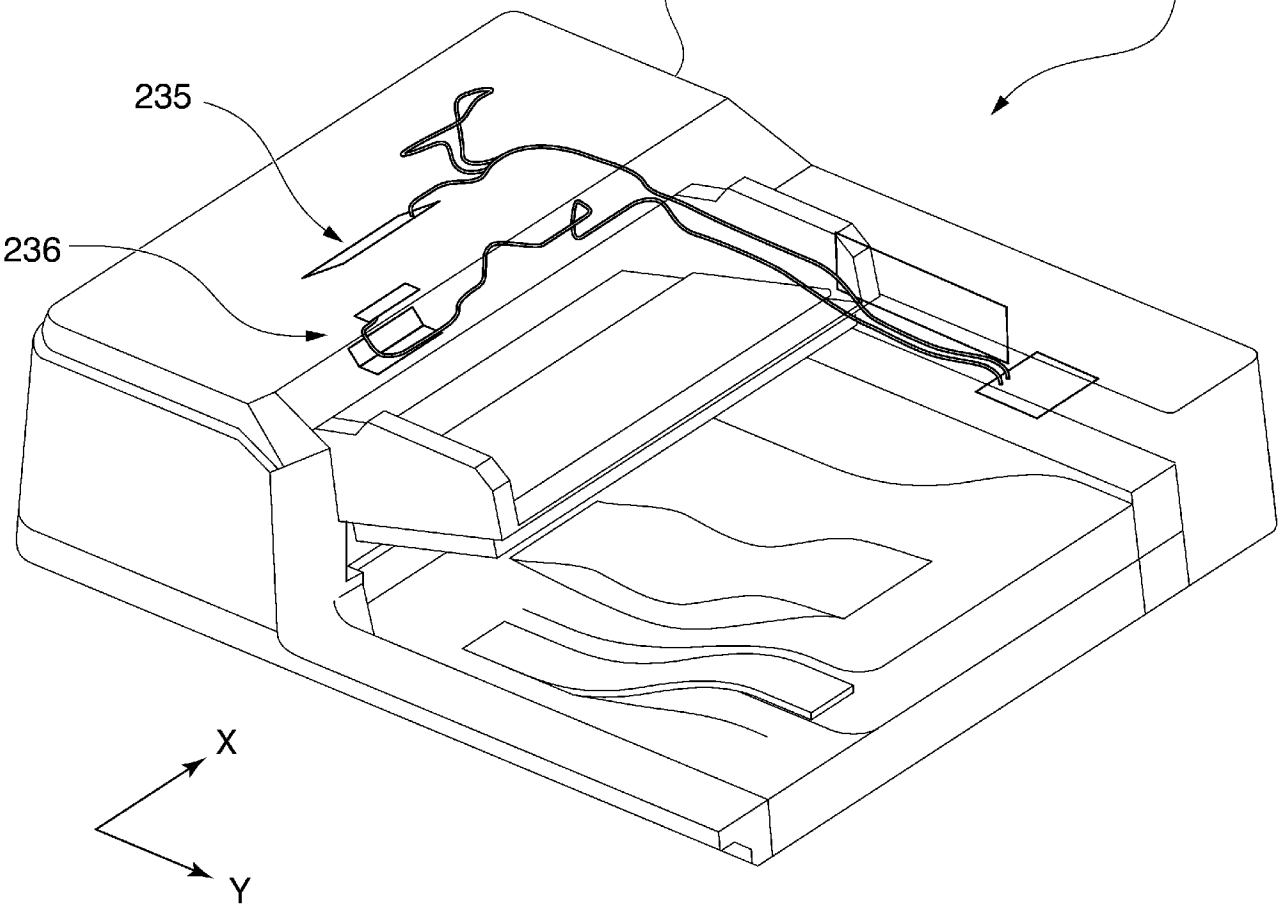
FIG. 2 is a transparent view of an ADF 200.
Figure 3:
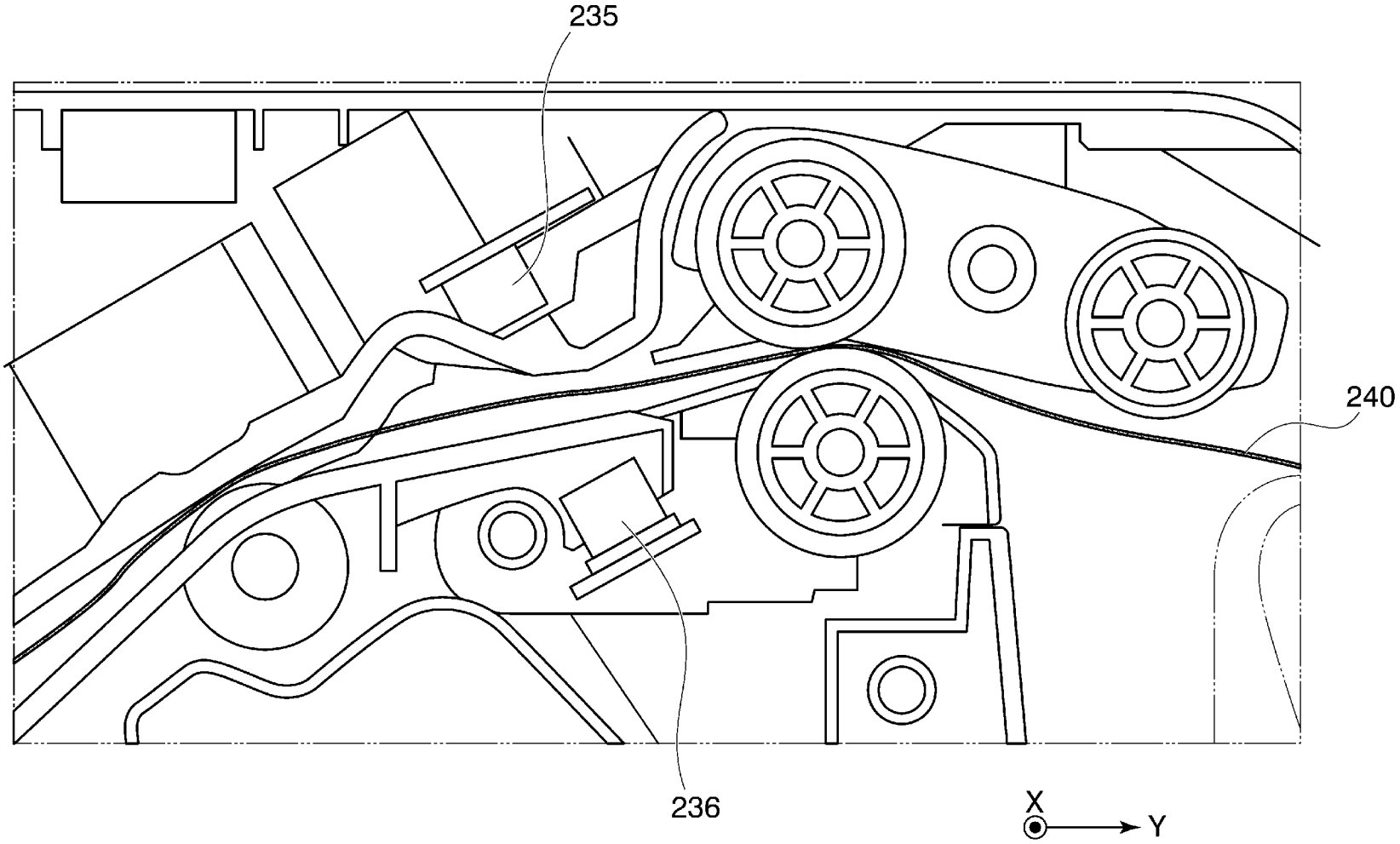
FIG. 3 is a view illustrating a transmitter 236 and a receiver 235.

FIG. 2 is a transparent view of the ADF 200. FIG. 3 is a cross-sectional view of the ADF 200. In the present embodiment, the ADF 200 includes a transmitter 236 and a receiver 235 in order to detect double feed in which the sheets are conveyed while being overlapped. FIGS. 2 and 3 illustrate the transmitter 236 and the receiver 235. FIG. 3 illustrates a conveyance path 240 through which the sheets are conveyed. In FIGS. 2 and 3, some configurations not related to the present embodiment are omitted.

As illustrated in FIG. 2, the transmitter 236 and the receiver 235 are provided inside the ADF cover 204. As illustrated in FIG. 3, the transmitter 236 transmits an ultrasonic wave to the conveyance path 240. The receiver 235 is provided so as to face the transmitter 236 with the conveyance path 240 in between, and receives the ultrasonic wave transmitted by the transmitter 236.

Figure 4:
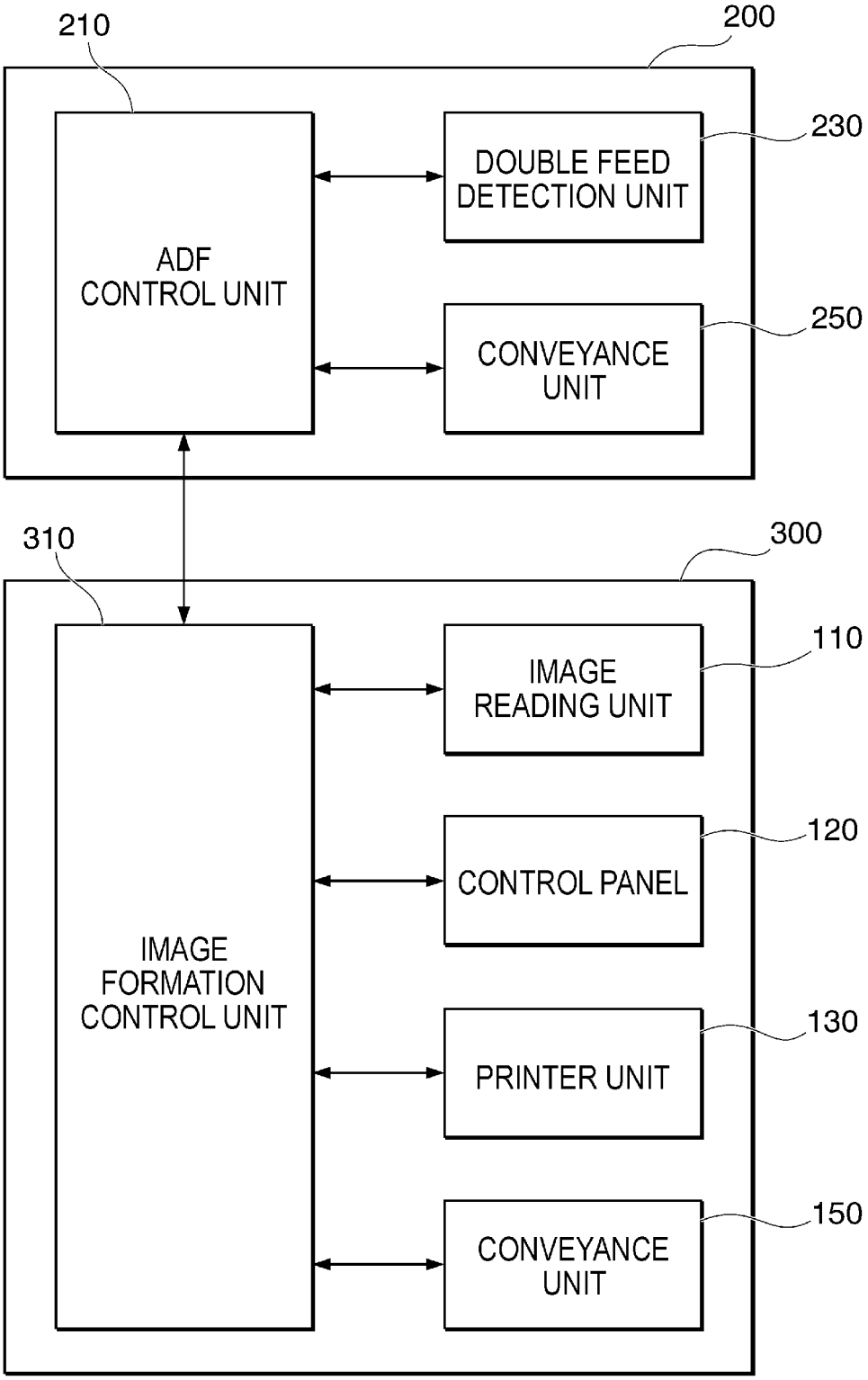
FIG. 4 is a view illustrating a control system of the image processing apparatus 100.

FIG. 4 is a view illustrating a control system of the image processing apparatus 100.

FIG. 4 illustrates the image processing apparatus 100 in two configurations (ADF 200, main body 300). The main body 300 has a configuration in which the ADF 200 is removed from the image processing apparatus 100.

The ADF 200 includes an ADF control unit 210, a double feed detection unit 230, and a conveyance unit 250. The ADF control unit 210 controls the entire ADF 200. The ADF control unit 210 includes a central processing unit (CPU), an application specific integrated circuit (ASIC), and the like (not illustrated). Further, the ADF control unit 210 includes a storage device (not illustrated). The storage device stores programs, various data, and the like. The storage device includes read only memory (ROM), random access memory (RAM), and the like. The ADF control unit 210 communicates with an image formation control unit 310, which will be described later.

The double feed detection unit 230 detects double feed in the conveyance path 240. The details of the double feed detection unit 230 will be described later. The conveyance unit 250 conveys the sheet along the conveyance path 240.

The main body 300 includes the image formation control unit 310, an image reading unit 110, the control panel 120, the printer unit 130, and a conveyance unit 150. Among these units, the control panel 120 and the printer unit 130 have already been described and will not be described.

The image formation control unit 310 controls the entire main body 300. The main body 300 includes a CPU, an ASIC, and the like (not illustrated). Further, the main body 300 includes a storage device (not illustrated). The storage device stores programs, various data, and the like. The storage device includes ROM, RAM, and the like. The main body 300 communicates with the ADF control unit 210.

The image reading unit 110 reads image information to be read based on brightness and darkness of light. The image information to be read is the image information drawn on the sheet conveyed by the ADF 200 or the sheet placed on a platen glass 202. The image reading unit 110 records the read image information. The recorded image information may be transmitted to another information processing apparatus via a network. The recorded image information may be formed on the sheet by the printer unit 130.

The conveyance unit 150 feeds the sheet placed on the sheet accommodating unit 140 or a bypass tray (not illustrated), or conveys the sheet in the main body 300.

Figure 5:
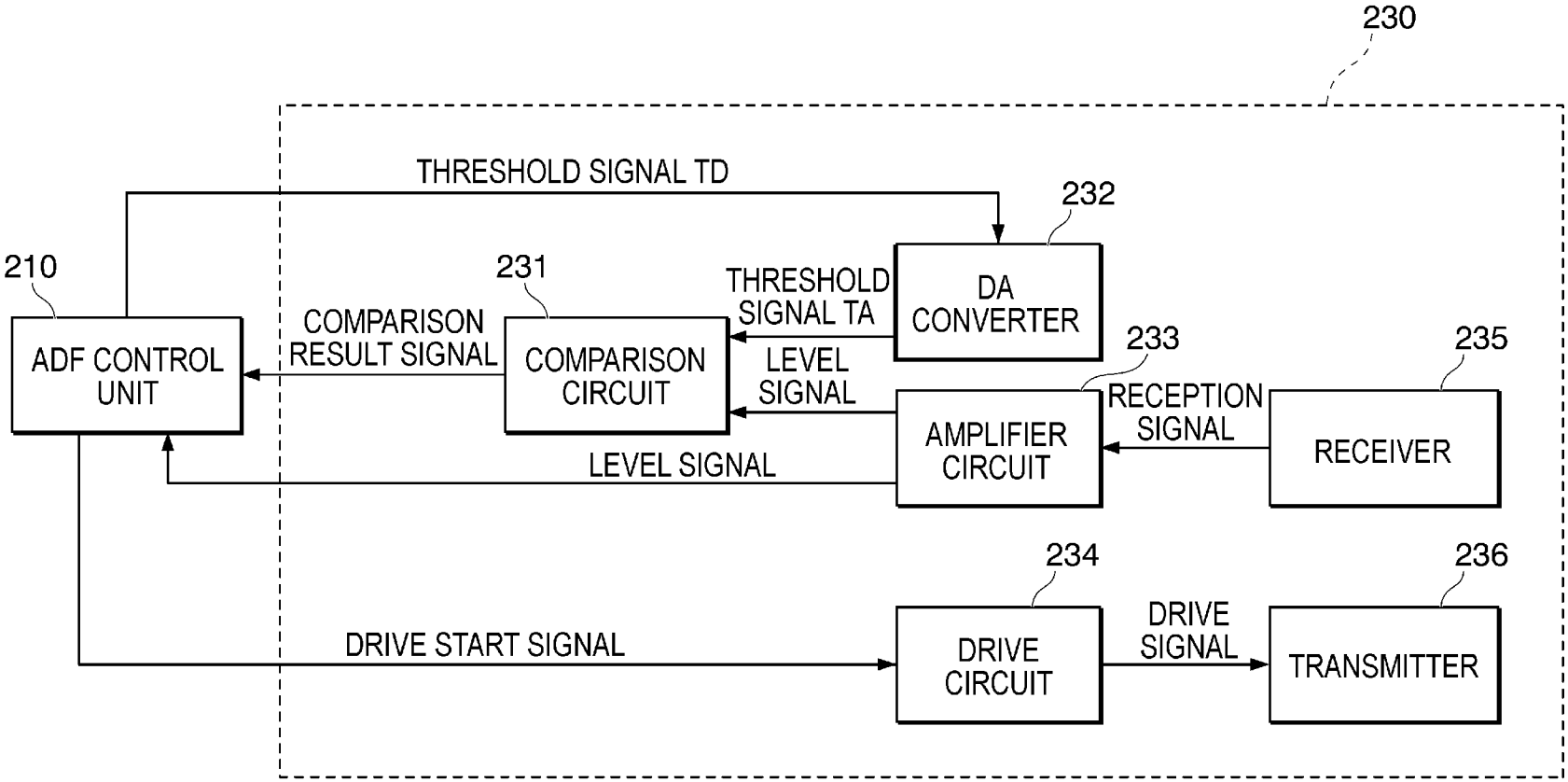
FIG. 5 is a view illustrating a configuration of a double feed detection unit 230.

FIG. 5 is a view illustrating a configuration of the double feed detection unit 230. The double feed detection unit 230 includes a comparison circuit 231, a DA converter 232, the amplifier circuit 233, the drive circuit 234, the receiver 235, and the transmitter 236.

The ADF control unit 210 outputs a drive start signal instructing the drive circuit 234 to transmit an ultrasonic wave to the transmitter 236. If the drive start signal is input, the drive circuit 234 outputs a drive signal to the transmitter 236. If the drive signal is input, the transmitter 236 transmits the ultrasonic wave for a predetermined period of time.

The receiver 235 outputs a reception signal according to the intensity of the received ultrasonic wave to the amplifier circuit 233. The amplifier circuit 233 amplifies the reception signal and outputs the reception signal as a level signal to the inverting input terminal of the comparison circuit 231 and the ADF control unit 210. The level signal indicates an analog voltage value, and this voltage value is also called a level voltage value.

The ADF control unit 210 outputs a threshold signal TD for determining whether or not the sheet is double-fed in the conveyance path by the comparison circuit 231 to the DA converter 232. The threshold signal TD is a digital signal indicating a threshold signal TA described later. The DA converter 232 converts the threshold signal TD of the input digital signal into an analog signal and outputs the analog signal as the threshold signal TA to the non-inverting input terminal of the comparison circuit 231. The voltage value indicated by the level signal output from the amplifier circuit 233 if the receiver 235 does not receive any ultrasonic waves is also referred to as an offset voltage value.

The comparison circuit 231 compares the level signal and the threshold signal TA, and outputs a comparison result signal according to the comparison result. In the present embodiment, the comparison circuit 231 outputs a comparison result signal indicating Low if the level voltage value is equal to or higher than the threshold signal TA. If the level voltage value is less than the threshold signal TA, the comparison circuit 231 outputs a comparison result signal indicating High.

The ADF control unit 210 determines whether or not there is a possibility of a defect in the double feed detection function of detecting double feed based on the comparison result signal and the level signal. Based on this determination result, the image formation control unit 310 is notified as necessary.

Figure 6:
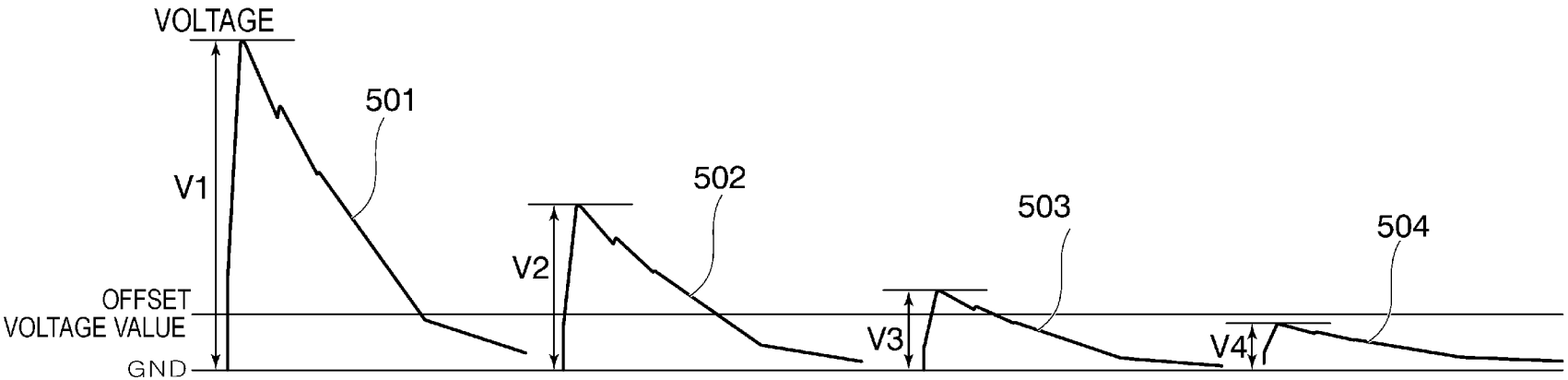
FIG. 6 is a graph illustrating the voltage value indicated by a level signal output from an amplifier circuit 233.

FIG. 6 is a graph illustrating the voltage value indicated by the level signal output from the amplifier circuit 233. The vertical axis illustrates a voltage value. The horizontal axis indicates time. A graph 501 illustrates the voltage value that is output if the sheet is not conveyed. The level signal peak voltage value of the graph 501 is V1. A graph 502 illustrates the voltage value output if one sheet of plain paper is conveyed. The level signal peak voltage value of the graph 502 is V2. A graph 503 illustrates the voltage value output if one sheet thicker than plain paper is conveyed. The level signal peak voltage value of the graph 503 is V3. A graph 504 illustrates the voltage value output if double feed occurs. The level signal peak voltage value of the graph 504 is V4.

As illustrated in FIG. 6, the level signal peak voltage values V1, V2, and V3 if double feed does not occur are all larger than the offset voltage value. On the other hand, the level signal peak voltage value V4 if double feed occurs is smaller than the offset voltage value.

As a result, the comparison circuit 231 outputs Low if double feed does not occur. The comparison circuit 231 outputs High if double feed occurs. In the following description, if the voltage value indicated by the level signal is equal to or higher than the threshold signal TA voltage value, the voltage value may be expressed as a non-double feed voltage value. If the voltage value indicated by the level signal is less than the threshold signal TA voltage value, the voltage value may be expressed as a double feed voltage value.

Figure 7:
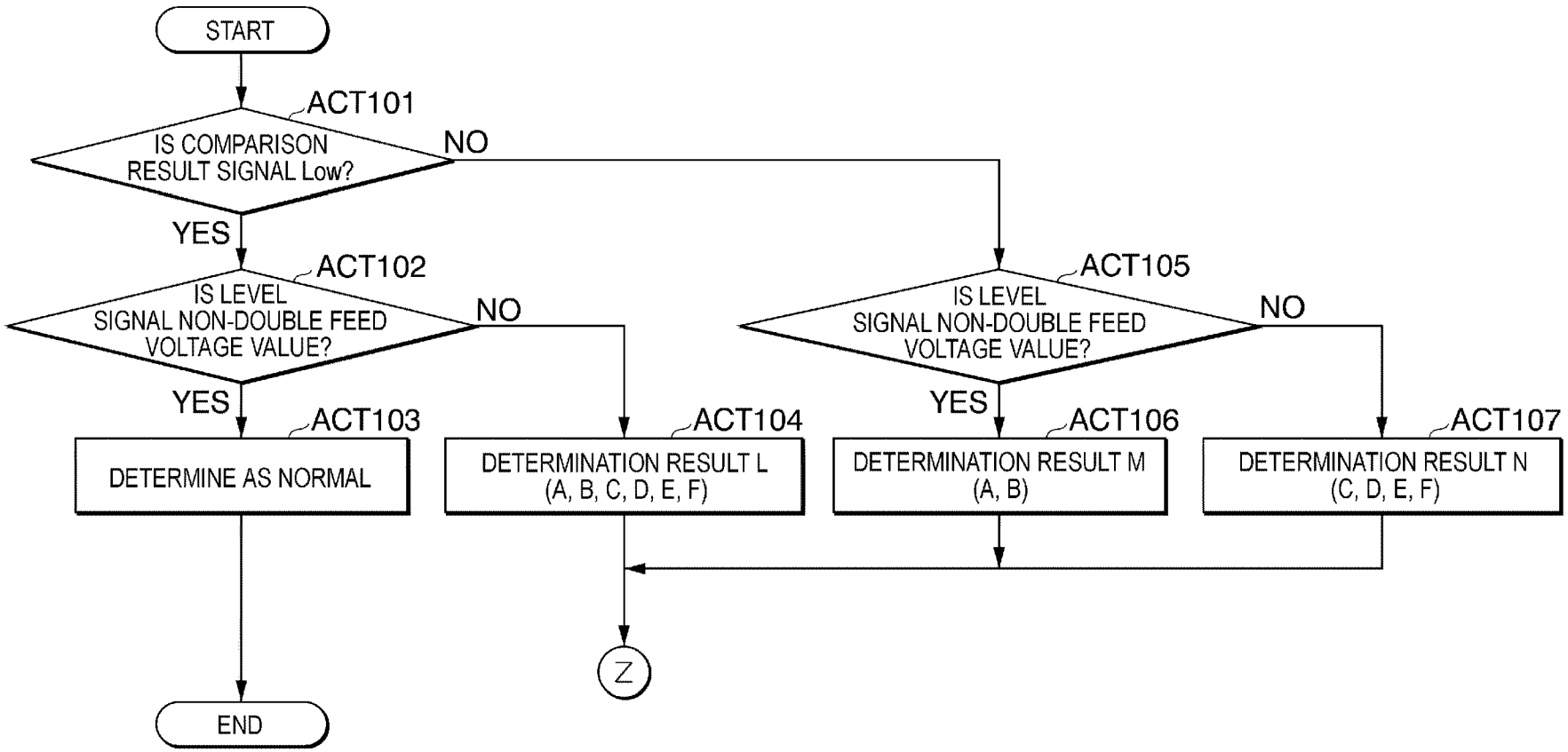
FIG. 7 is a flowchart illustrating the processing flow of an ADF control unit 210.
Figure 8:
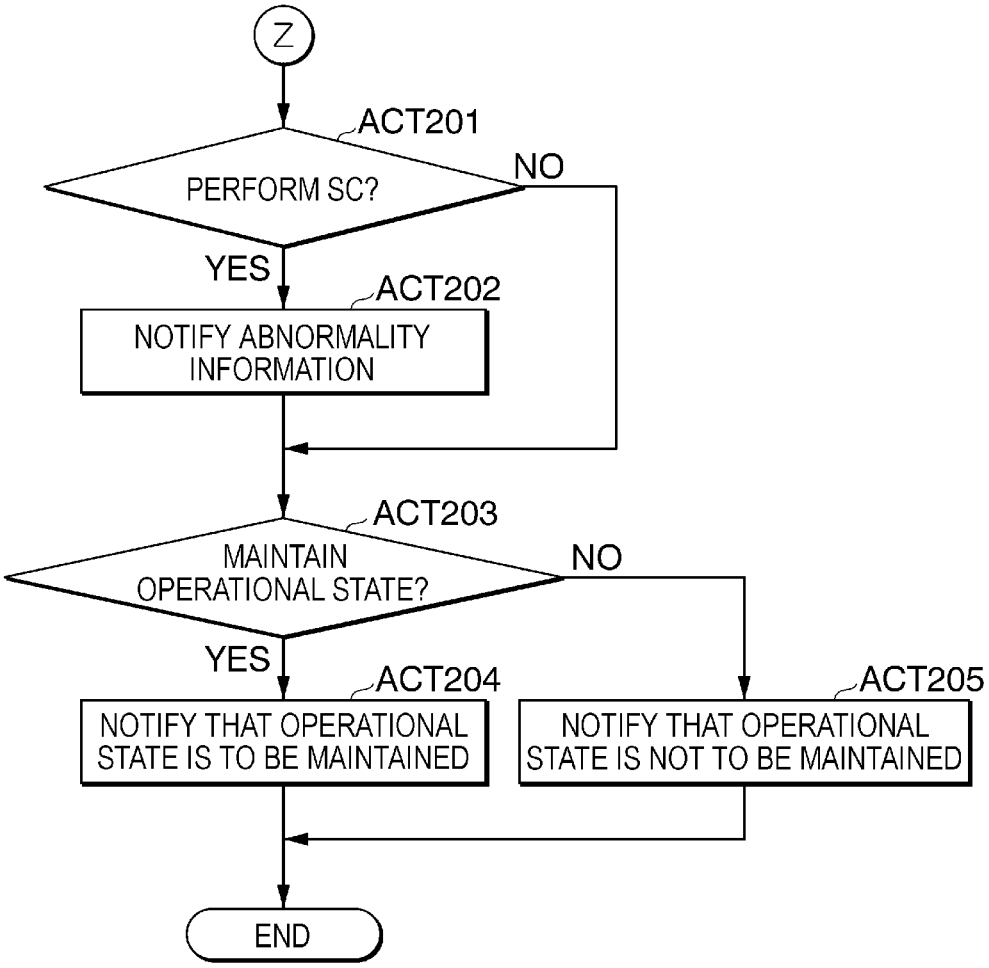
FIG. 8 is a flowchart illustrating the processing flow of the ADF control unit 210.

FIGS. 7 and 8 are flowcharts illustrating the processing flow of the ADF control unit 210. This flowchart illustrates the flow of processing executed by a user or a service person if conveying one sheet placed on the ADF 200. Therefore, since the double feed does not occur, if the function of the double feed detection unit 230 is normal, the signal output at the time of double feed is not output. Similarly, the level signal does not indicate a double feed voltage value. Further, the comparison result signal does not indicate High.

Further, in the following flowchart, "A" indicates the comparison circuit 231. "B" indicates the DA converter 232. "C" indicates the amplifier circuit 233. "D" indicates the drive circuit 234. "E" indicates the receiver 235. "F" indicates the transmitter 236. When A to F are not particularly distinguished, each of A to F is expressed as a detection configuration. Further, the possibility of a defect in a certain detection configuration includes the possibility of a defect in a circuit component related to the detection configuration. That is, the possibility of a defect is not limited to a defect of only a certain detection configuration.

The ADF control unit 210 determines whether or not the comparison result signal indicates Low (ACT 101). If the comparison result signal indicates Low (ACT 101: YES), the ADF control unit 210 determines whether or not the level signal indicates a non-double feed voltage value (ACT 102). If the level signal indicates the non-double feed voltage value (ACT 102: YES), the ADF control unit 210 determines that the function of the double feed detection unit 230 is normal (ACT 103), and ends the processing.

In the above ACT 102, if the level signal does not indicate the non-double feed voltage value (ACT 102: NO), the ADF control unit 210 sets the determination result for the ADF 200 as a determination result L (ACT 104), and proceeds to ACT 201 of FIG. 8. The determination result L indicates that there is a possibility of a defect in A, B, C, D, E, or F.

In this way, if one sheet is conveyed to the conveyance path 240, if the comparison result signal indicates that one sheet has been conveyed (ACT 101: YES), and the level signal indicates a reception level indicating that double feed has occurred (ACT 102: NO), the ADF control unit 210 performs the following processing. That is, the ADF control unit 210 determines that there is a possibility of a defect in the comparison circuit 231, the amplifier circuit 233, the DA converter 232, the drive circuit 234, the receiver 235, or the transmitter 236.

In the above ACT 101, if the comparison result signal does not indicates Low (ACT 101: NO), the ADF control unit 210 determines whether or not the level signal indicates the non-double feed voltage value (ACT 105). If the level signal indicates the non-double feed voltage value (ACT 105: YES), the ADF control unit 210 sets the determination result for the ADF 200 as a determination result M (ACT 106), and proceeds to ACT 201 of FIG. 8. The determination result M indicates that there is a possibility of a defect in A or B.

In this way, if one sheet is conveyed to the conveyance path 240, if the comparison result signal indicates double feed (ACT 101: NO), and the level signal indicates a reception level of if one sheet has been conveyed (ACT 105: YES) the ADF control unit 210 determines that there is a possibility of a defect in the comparison circuit 231 or the DA converter 232.

If the level signal does not indicate the non-double feed voltage value (ACT 105: NO), the ADF control unit 210 sets the determination result for the ADF 200 as a determination result N (ACT 107), and proceeds to ACT 201 of FIG. 8. The determination result N indicates that there is a possibility of a defect in C, D, E or F.

In this way, if one sheet is conveyed to the conveyance path 240, if the comparison result signal indicates that double feed has occurred (ACT 101: NO), and the level signal indicates a reception level indicating that double feed has occurred (ACT 105: NO), the ADF control unit 210 determines that there is a possibility of a defect in the amplifier circuit 233, the drive circuit 234, the receiver 235, or the transmitter 236.

Next, the flowchart of FIG. 8 will be described. FIG. 8 is processing to be executed if it is determined that there is a possibility of a defect in any of A to F. The ADF control unit 210 determines whether or not to perform SC (ACT 201). The SC is a service-person call for notifying information (abnormal information) related to the double feed detection function. Whether or not to perform the SC is determined based on the value stored as the set value in the storage device of the ADF control unit 210.

The abnormality information here is information indicating any of A to F, which are determined to have a possibility of a defect in each of ACT 104, ACT 106, and ACT 107. The abnormality information is notified to the image formation control unit 310. The image formation control unit 310 notifies a predetermined notification destination (for example, a server viewed by a service person) as a notification destination of the abnormal information.

If it is determined to perform the SC (ACT 201: YES), the ADF control unit 210 notifies the image formation control unit 310 of the abnormality information (ACT 202). If it is not determined to perform the SC (ACT 201: NO), the ADF control unit 210 proceeds to ACT 203.

The ADF control unit 210 determines whether or not to maintain the operational state of the ADF 200 (ACT 203). "Maintaining an operational state" means that the ADF 200 is maintained in a usable state by ignoring the defect of the double feed detection function. Whether or not to maintain the operational state is determined based on the value stored as the set value in the storage device of the ADF control unit 210. Ignoring the defect of the double feed detection function is also expressed as disconnecting the double feed detection function.

If it is determined to maintain the operational state (ACT 203: YES), the ADF control unit 210 notifies the image formation control unit 310 that the operational state is to be maintained (ACT 204), and ends the processing. If it is not determined to maintain the operational state (ACT 203: NO), the ADF control unit 210 notifies the image formation control unit 310 that the ADF 200 cannot be operated (ACT 205), and ends the processing.

The image formation control unit 310 which is notified that the operational state is maintained displays information indicating that there is a possibility of a defect in the ADF 200 but is operational on the control panel 120. The image formation control unit 310 which is notified that the ADF 200 cannot be operated displays information indicating that since there is a possibility of a defect in the ADF 200, the ADF 200 cannot be operated on the control panel 120.

As illustrated in the flowchart described above, since it is possible to narrow down the detection configurations with a possibility of a defect, the user or the service person can easily determine whether the detected double feed is due to true double feed or a defect. In addition, even if there is a possibility of a defect, it is possible to set whether or not to perform the SC. In addition, it is possible to set whether or not to maintain the operational state. As a result, the image processing apparatus 100 can improve the usability for the user.

Next, the determination results L, M, and N will be described. The determination results L, M, and N indicate the detection configurations in which it is considered that there is a relatively high possibility of a defect. Therefore, it does not indicate that no defect has occurred in the detection configurations other than the detection configurations illustrated in the determination results L, M, and N. That is, there is a possibility of a defect in a detection configuration other than the detection configurations illustrated in the determination results L, M, and N. Based on this, each determination result will be described below.

First, the determination result L will be described. The determination result L was a determination result if the comparison result signal indicated Low and the level signal did not indicate a non-double feed voltage value (that is, when indicating a double feed voltage value).

If the comparison result signal illustrates Low, the comparison circuit 231 outputs Low even though the level signal indicates a double feed voltage value, and therefore there is a possibility of a defect in the comparison circuit 231. Even if the comparison circuit 231 is normal, the comparison result signal may indicate Low because the voltage value indicated by the threshold signal TA output by the DA converter 232 is lower than the level signal due to a defect of the DA converter 232.

If the level signal indicates a double feed voltage value, there is a possibility of a defect in the amplifier circuit 233 first. Even if the amplifier circuit 233 is normal, the level signal may indicate a double feed voltage value because the receiver 235 cannot output the reception signal reflecting the reception level due to a defect of the receiver 235.

Even if the receiver 235 is normal, the receiver 235 may output a reception signal indicating a low received ultrasonic wave because the transmitter 236 is not transmitting an ultrasonic wave at a normal magnitude due to a defect of the transmitter 236.

Even if the transmitter 236 is normal, the transmitter 236 may not be able to transmit an ultrasonic wave because the drive signal is not output due to a defect in the drive circuit 234.

From the above, the determination result L is a determination result that there is a possibility of a defect in A, B, C, D, E, or F.

Next, the determination result M will be described. The determination result M was a determination result if the comparison result signal did not indicate Low (that is, if indicating High) and the level signal indicated the non-double feed voltage value.

The amplifier circuit 233, the receiver 235, the transmitter 236, and the drive circuit 234 are considered normal because the level signal indicates the non-double feed voltage value.

On the other hand, since the comparison circuit 231 outputs High even though the level signal indicates the non-double feed voltage value, there is a possibility of a defect in the comparison circuit 231. Even if the comparison circuit 231 is normal, the comparison result signal may indicate High because the voltage value indicated by the threshold signal TA output by the DA converter 232 is higher than the level signal due to a defect of the DA converter 232.

From the above, the determination result M is a determination result that there is a possibility of a defect in A or B.

Next, the determination result N will be described. The determination result N was a determination result if the comparison result signal did not indicate Low (that is, when indicating High) and the level signal did not indicate the non-double feed voltage value (that is, when indicating a double feed voltage value).

Since the level signal indicates the double feed voltage value and the comparison result signal indicates High, the comparison circuit 231 and the DA converter 232 are considered to be normal.

If the level signal indicates the double feed voltage value, there is a possibility of a defect in the amplifier circuit 233 first. Even if the amplifier circuit 233 is normal, the level signal may indicate the double feed voltage value because the receiver 235 cannot output the reception signal reflecting the reception level due to a defect of the receiver 235.

Even if the receiver 235 is normal, the receiver 235 may output a reception signal indicating a low received ultrasonic wave because the transmitter 236 is not transmitting an ultrasonic wave at a normal magnitude due to a defect of the transmitter 236.

Even if the transmitter 236 is normal, the transmitter 236 may not be able to transmit an ultrasonic wave because the drive signal is not output due to a defect in the drive circuit 234.

From the above, the determination result N is a determination result that there is a possibility of a defect in C, E, D or F.

Figure 9:
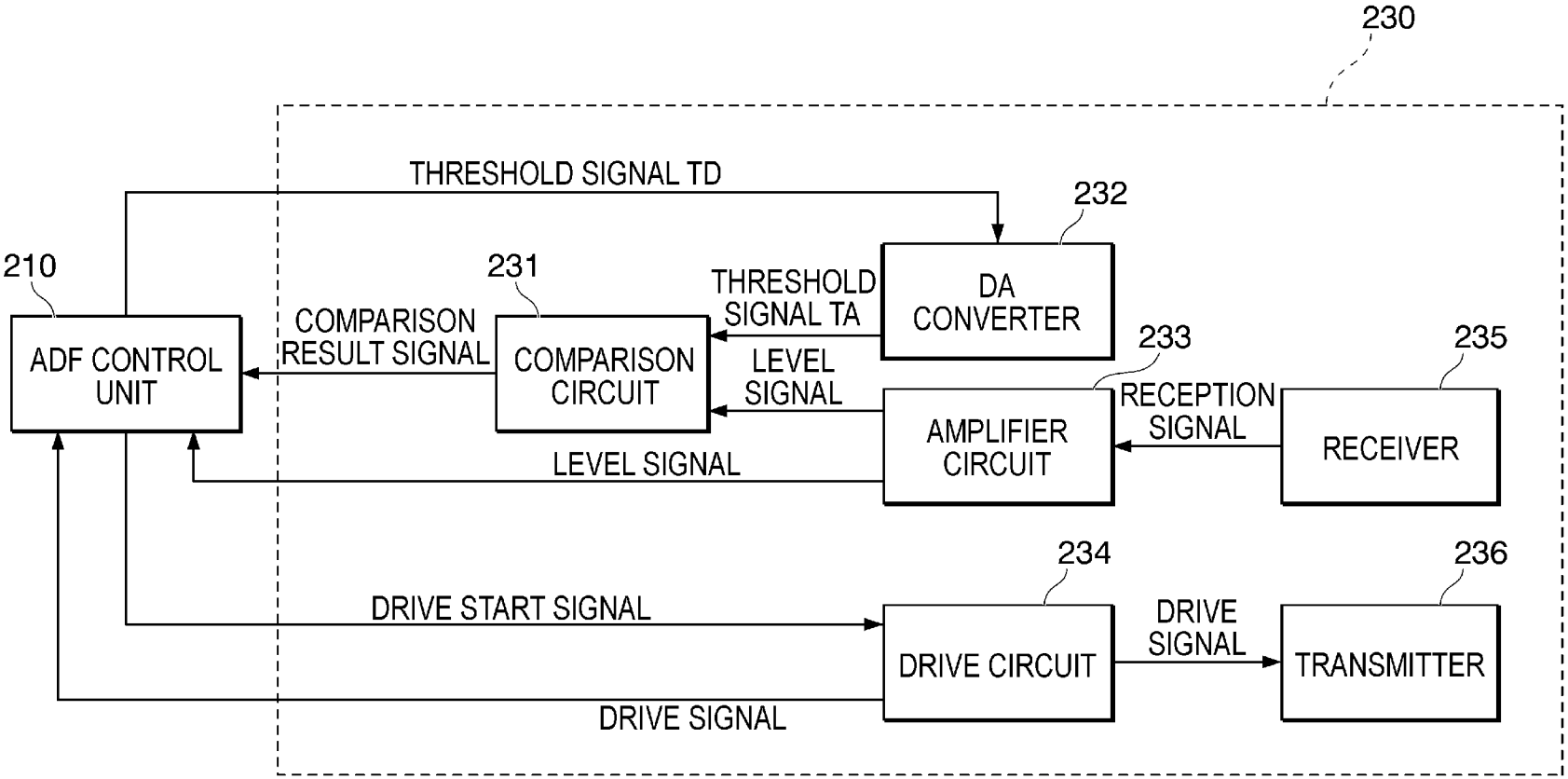
FIG. 9 is a view illustrating a configuration if a drive circuit 234 outputs a drive signal to the ADF control unit 210.

In the embodiment described above, the drive circuit 234 may output the drive signal to the ADF control unit 210 if a drive signal is output to the transmitter 236. FIG. 9 is a view illustrating a configuration if the drive circuit 234 outputs a drive signal to the ADF control unit 210.

FIG. 9 is the same as FIG. 5 except that a drive signal is output from the drive circuit 234 to the ADF control unit 210. The ADF control unit 210 is configured to receive the output of a drive signal. As a result, the ADF control unit 210 can determine whether or not there is a defect in the drive circuit 234.

For example, in the case of ACT 104 of FIG. 7, if a drive signal is output to the ADF control unit 210, it can be seen that D is operating normally, the determination result is that there is a possibility of a defect in A, B, C, E, or F.

Further, for example, in the case of ACT 107 of FIG. 7, if a drive signal is output to the ADF control unit 210, it can be seen that D is operating normally, the determination result is that there is a possibility of a defect in C, E, or F.

If a drive signal is output from the drive circuit 234 to the ADF control unit 210 in this way, it is possible to reduce the number of detection configurations that may cause a defect, and therefore it is possible to easily determine whether double feed or a defect has occurred.

If the entire detection configurations are normal, the storage device of the ADF control unit 210 may store the initial value of the voltage value of the level signal output from the amplifier circuit 233 if the transmitter 236 is driven. By storing the initial value, the ADF control unit 210 can determine that the voltage value has decreased due to some influence such as paper dust, life, or failure of a sensor or the like. The ADF control unit 210 can determine that the amplifier circuit 233, the receiver 235, the transmitter 236, and the circuit components related thereto are being damaged as the voltage value decreases. The ADF control unit 210 can predict a failure by using the decrease in the voltage value from the initial value.

In the present embodiment, as an image processing apparatus, the image processing apparatus 100 provided with a printer unit is taken as an example, but the present embodiment is not limited thereto. For example, the image processing apparatus may be a scanner that does not have a printer unit and only reads a document. Further, as the conveyance path, the conveyance path provided in the ADF 200 is taken as an example, but may be a conveyance path for conveying the sheet to be printed in the printer unit, for example.

As described above, the image processing apparatus 100 according to the present embodiment can easily determine whether the detected double feed is due to true double feed or a defect.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image processing apparatus, comprising:

a transmitter that transmits an ultrasonic wave to a conveyance path through which a sheet is conveyed;

a receiver that faces the transmitter with the conveyance path in between, and receives the ultrasonic wave transmitted by the transmitter;

a comparison circuit that compares a level signal indicating a reception level of the ultrasonic wave received by the receiver with a threshold signal for determining whether or not sheets are double-fed in the conveyance path, and outputs a comparison result signal according to a comparison result;

a control component configured to determine whether or not there is a possibility of a defect in a double feed detection function of detecting double feed based on the comparison result signal and the level signal;

an amplifier circuit that amplifies a signal output by the receiver and outputs the amplified signal as the level signal;

a DA converter that converts a digital signal indicating the threshold signal output from the control component into an analog signal and outputs the converted signal as the threshold signal; and a drive circuit that outputs a drive signal to the transmitter according to an instruction from the control component, wherein when outputting the drive signal to the transmitter, the drive circuit outputs the drive signal to the control component, and the control component determines whether or not there is a possibility of a defect in the double feed detection function based on the drive signal in addition to the comparison result signal and the level signal.

2. The image processing apparatus according to claim 1, wherein when determining that there is a possibility of a defect in the double feed detection function, the control component notifies a predetermined notification destination of information regarding the double feed detection function.

3. The image processing apparatus according to claim 1, wherein the conveyance path is in an automatic document feeder that automatically conveys the sheet, and even when determining that there is a possibility of a defect in the double feed detection function, the control component maintains the automatic document feeder in an operational state.

4. The image processing apparatus according to claim 1, wherein when one sheet is conveyed to the conveyance path, if the comparison result signal indicates that one sheet is conveyed, and the level signal indicates a reception level indicating double feed, the control component determines that there is a possibility of a defect in the comparison circuit, the amplifier circuit, the DA converter, the drive circuit, the receiver, or the transmitter.

5. The image processing apparatus according to claim 1, wherein when one sheet is conveyed to the conveyance path, if the comparison result signal indicates double feed, and the level signal indicates a reception level of one sheet is conveyed, the control component determines that there is a possibility of a defect in the comparison circuit or the DA converter.

6. The image processing apparatus according to claim 1, wherein when one sheet is conveyed to the conveyance path, if the comparison result signal indicates double feed, and the level signal indicates a reception level indicating double feed, the control component determines that there is a possibility of a defect in the amplifier circuit, the drive circuit, the receiver, or the transmitter.

7. The image processing apparatus according to claim 1, wherein when one sheet is conveyed to the conveyance path, if the comparison result signal indicates that one sheet is conveyed, the level signal indicates a reception level indicating double feed, and the drive signal is output from the drive circuit to the control component, the control component determines that there is a possibility of a defect in the comparison circuit, the amplifier circuit, the DA converter, the receiver, or the transmitter.

8. The image processing apparatus according to claim 1, wherein when one sheet is conveyed to the conveyance path, if the comparison result signal indicates double feed, the level signal indicates a reception level indicating double feed, and the drive signal is output from the drive circuit to the control component, the control component determines that there is a possibility of a defect in the amplifier circuit, the receiver, or the transmitter.

9. A double feed monitoring system, comprising:

a transmitter that transmits an ultrasonic wave to a conveyance path through which a sheet is conveyed;

a receiver that faces the transmitter with the conveyance path in between, and receives the ultrasonic wave transmitted by the transmitter;

a comparison circuit that compares a level signal indicating a reception level of the ultrasonic wave received by the receiver with a threshold signal for determining whether or not sheets are double-fed in the conveyance path, and outputs a comparison result signal according to a comparison result;

a control component configured to determine whether or not there is a possibility of a defect in a double feed detection function of detecting double feed based on the comparison result signal and the level signal;

an amplifier circuit that amplifies a signal output by the receiver and outputs the amplified signal as the level signal;

a DA converter that converts a digital signal indicating the threshold signal output from the control component into an analog signal and outputs the converted signal as the threshold signal; and a drive circuit that outputs a drive signal to the transmitter according to an instruction from the control component, wherein when outputting the drive signal to the transmitter, the drive circuit outputs the drive signal to the control component, and the control component determines whether or not there is a possibility of a defect in the double feed detection function based on the drive signal in addition to the comparison result signal and the level signal.

10. The double feed monitoring system according to claim 9, wherein when one sheet is conveyed to the conveyance path, if the comparison result signal indicates that one sheet is conveyed, and the level signal indicates a reception level indicating double feed, the control component determines that there is a possibility of a defect in the comparison circuit, the amplifier circuit, the DA converter, the drive circuit, the receiver, or the transmitter.

11. The double feed monitoring system according to claim 9, wherein when one sheet is conveyed to the conveyance path, if the comparison result signal indicates double feed, and the level signal indicates a reception level indicating double feed, the control component determines that there is a possibility of a defect in the amplifier circuit, the drive circuit, the receiver, or the transmitter.

12. The double feed monitoring system according to claim 9, wherein when one sheet is conveyed to the conveyance path, if the comparison result signal indicates that one sheet is conveyed, the level signal indicates a reception level indicating double feed, and the drive signal is output from the drive circuit to the control component, the control component determines that there is a possibility of a defect in the comparison circuit, the amplifier circuit, the DA converter, the receiver, or the transmitter.

* * * * *